United States Patent [19]

Martinez

[11] Patent Number: 4,970,006

[45] Date of Patent: Nov. 13, 1990

[54] KNIFE STAND

[75] Inventor: Arturo Martinez, Milan, Italy

[73] Assignee: Coltellerie Montana S.r.l., Como, Italy

[21] Appl. No.: 417,069

[22] Filed: Oct. 4, 1989

[30] Foreign Application Priority Data

Feb. 6, 1989 [IT] Italy ..... 19321 A/89

[51] Int. Cl.[5] ..... A47F 7/00

[52] U.S. Cl. ..... 248/37.3; 211/70.6

[58] Field of Search ..... 248/37.3, 37.6, 314; 211/70.1, 70.6, 70.8; 206/553

[56] References Cited

U.S. PATENT DOCUMENTS 4,497,412 2/1985 Cabelle ..... 248/37.6 X 4,537,315 8/1985 Griffin ..... 248/37.3 X 4,575,939 3/1986 Buthtel ..... 248/373 X

FOREIGN PATENT DOCUMENTS 466545 9/1978 Fed. Rep. of Germany ..... 211/70.7

*Primary Examiner*—Alvin C. Chin-Shue

*Attorney, Agent, or Firm*—Notaro & Michalos

[57] ABSTRACT

A knife stand is disclosed which comprises a plurality of elements, each defining at least one socket adapted to receive the blade of a respective knife, which elements are laid side-by-side, structurally independent of one another and clamped into a pack. By virtue of this construction, the stand can be assembled to suit the number of knives to be accomodated, and readily disassembled for cleaning.

11 Claims, 2 Drawing Sheets

10f
10a
11
13
13a
13b
13c
14
15
17
18
19
20
21
22
1
2
3a
3b

KNIFE STAND

DESCRIPTION

This invention relates to a knife stand comprising a body formed with a plurality of sockets, each intended to hold the blade of a knife therein.

Stands of the above kind have been known and widely used to hold plural knives having different features in a proper and safe manner while letting them within easy reach at all times.

Most of the prior knife stands are usually made of wood in the form of a parallelepipedic block provided with a plurality of slots, each adapted to receive the blade of a knife. The stand is machined to have a rest base and one or more feet thereon to enable the stand to be laid onto a shelf in a slightly canted-up position.

Such prior stands have certain drawbacks both connected with their maintenance (in particular, they are difficult to keep clean) and, for some aspects, their fabrication.

It will be readily appreciated, in fact, that the knife blade holding sockets are quite difficult to clean carefully due to their small breadth, thereby the sanitary conditions that prevail within such sockets after prolonged use of the stand are bound to be rather doubtful.

In fabricating the stand, moreover, it is necessary that the number and type of the sockets to be provided in it be defined in an irreversible way. In order to change the type and/or layout of the sockets carved in the wood block, which sockets may have to be altered in shape, depth, breadth, and arrangement to suit a particular type of knife to be accommodated therein, the processing sequence for the stand requires to be changed accordingly, and where the number of the sockets in the stand is to be changed, the size of the initial blank must be also changed to suit.

In addition, the user cannot change any of the stand features (number, layout, and dimensions of the knife blade sockets) originally provided by the manufacturer.

The problem that underlies this invention is to provide a knife stand having such construction and performance characteristics as to overcome all of the drawbacks with which the cited prior art is beset.

This problem is solved by a knife stand as indicated being characterized in that said body comprises a plurality of elements structurally independent of one another and being each formed with at least one of said sockets, said elements being laid side-by-side and held together into a tight pack.

Advantageously, through said body there is passed at least one tie rod for clamping together said elements in a releasable manner. Further, each element comprises two parts releasbly coupled to each other, which parts are adapted to part across a plane extending longitudinally through said at least one socket.

The features and advantages of this invention will become more clearly apparent from the following detailed description of a preferred, though not exclusive, embodiment thereof, given by way of illustration and not of limitation with reference to the accompanying drawings, where:

Figures 3, 4, 5, 6, 7:
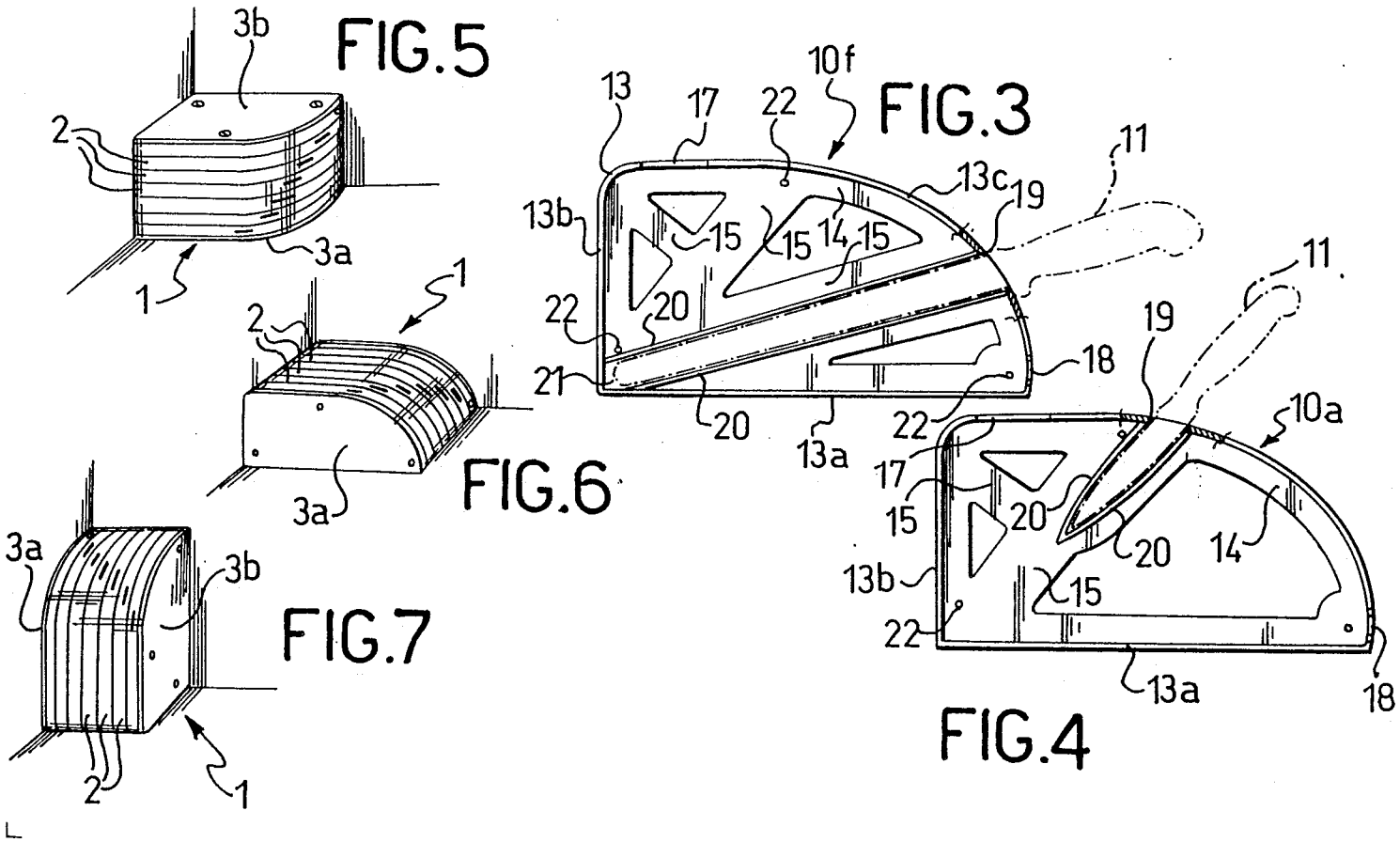

FIGS. 3 and 4 shown two different components of the stand in the previous figures; and FIGS. 5 to 7 show in perspective possible settings of the stand according to this invention.

In the drawing figures, the reference numeral 1 generally denotes a knife stand embodying this invention.

The stand 1 comprises a plurality (seven in the example shown) of elements, collectively designated 2. The elements 2 are laid side-by-side and clamped together into a pack between two cheek pieces 3*a*, 3*b* by means of tie rods 4, each tie rod having a stem 6 carrying a head 5, at one end, and the opposing or free end threaded to receive a cap 7 in releasable thread engagement thereon. The cheek pieces 3*a*, 3*b* are formed with seating recesses 8 adapted to receive the respective heads 5 and caps 7 of the tie rods 4 out of sight thereinto.

The elements 2 define two rest surfaces for the stand 1 which lie substantially at right angles to each other. A third rest surface is defined for the stand 1 by each of the cheek pieces 3*a* and 3*b*.

The elements 2 are all made up of two parts each, which parts are both molded from a plastics material or pressings of an aluminum alloy. A first part, 10*a*, 10*b*, 10*c*, 10*d*, 10*e*, 10*f* and 10*g*, has a different configuration for each of the elements 2, this difference in configuration being primarily dictated by the type and dimensions of the knife 11 blade for which each of the parts 10*a–g* is designed. The second parts, indicated at 12, are structurally the same for all the elements 2, and only differ from one another by their different colors.

Although differring in configuration, the first parts 10*a–g* are quite similar as far as their functional aspect is concerned. Accordingly, just one of them will be described in detail hereinafter, the description of the other parts being restricted to their differences.

Taking, for example, the part 10*f* shown in FIG. 3, which is designed to accommodate a long-bladed knife 11, it comprises a peripheral strip 13 defining two substantially straight sides 13*a*, 13*b* which lie at right angles to each other, and a third side 13*c* having a remote portion from the side 13*a* which is markedly curvilinear.

The strip 13 extends around and is made unitary with a plate 14, located at a near-central location relatively to said strip, through which there are formed broad lightening apertures defining a plurality of ribs 15 in radial arrangement.

Two cutouts 17, 18 are formed in the strip 13 along the side 13*c* which lie on the same side relatively to the plate 14, together with a slot 19.

On one of the ribs 15 which extends as far as the slot 19, there are formed two beads 20 bounding a socket 21 for receiving the blade of a respective knife 11.

The plate 14 is also formed with holes 22 for the tie rods 4 to pass through.

Each of the second parts 12 is removably associated with two corresponding ones of the first parts 10, wherebetween it is caught and also formed with a peripheral strip 25 surrounding a plate 26. The strip 25 is sized to fit inside the corresponding strip 13 of said two first parts 10 in mating relationship with it.

Formed at a middle location on the strip 25 is a raised bead 27 having the same thickness dimension as the strip 13.

Provided on the same side with respect to the bead 27 are also two enlarged portions 28, located at the cutouts 17, 18 such that they would stand proud through the strip 13 with the two parts 10, 12 coupled together.

The plate 26 is made unitary with the strip 25, on one side thereof, so as to come, with the parts 10, 12 coupled together, to bear on the corresponding beads 20 and close off the socket 21. The two parts 10, 12 can therefore be parted from each other across a plane extending through the corresponding socket 21.

Figure 1:
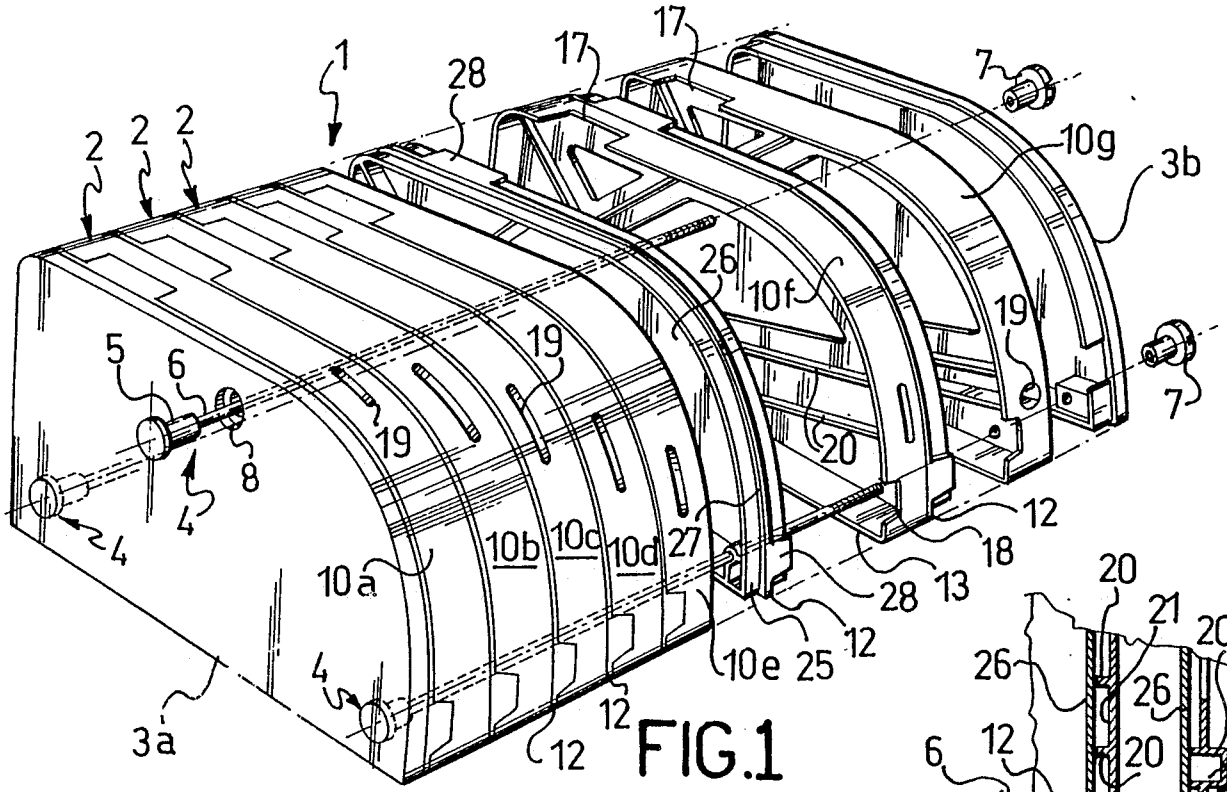
FIG. 1 is a fragmentary, exploded perspective view of a knife stand according to this invention.
Figure 2:
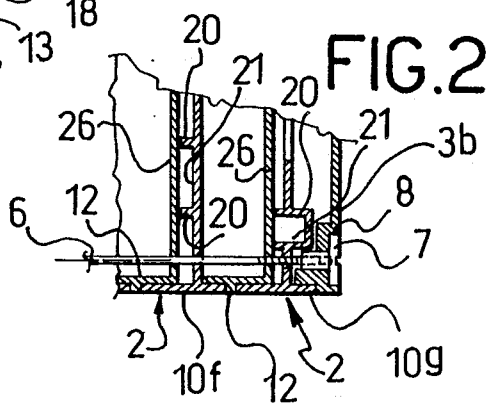
FIG. 2 is a sectional detail view of the knife stand shown in FIG. 1.

As shown in FIG. 1 and exemplified in FIG. 4, the remaining parts 10*a–e* only differ from the part 10*f* of the element 2 by the dimensions, location, and shape of the socket 21. It should be noted that the angular orientation of the sockets 21 is such that knives accommodated therein will lie in a fan-shaped arrangement effective to make selecting and grasping them out of the stand 1 an easier operation.

In the part 10*g*, the socket 21, which is adapted to accommodate a conventional knife sharpening tool of round cross-sectional shape, has an aperture 19 of circular shape and extends with a square shape through the plate 14 to a greater depth than the remaining sockets 21.

To assemble a stand 1 into a desired configuration, one is to provide a corresponding number of the elements 2 having first parts 10*a–g* with a socket 21 of the desired shape, couple such elements 2 together side-by-side, apply at either sides of the pack of elements 2 the respective end cheek pieces 3*a,b*, and clamp the whole tightly by means of the tie rods 4.

The reverse operation may be easily carried out by the user when the stand 1 is to be disassembled for cleaning purposes.

With reference to FIGS. 5–7, the peculiar shape of the elements 2 defines three different rest surfaces on the stand 1, of which two are defined at the sides 13*a*, 13*b* of the strips 13 and the third at the two cheek pieces 3*a,b*.

A first, self-evident advantage of the stand according to the invention is that its configuration can be varied as desired by changing the number and/or type of the elements 2 which comprise it. This both simplifies the manufacture of stands differring by the number and type of the knives that it can accommodate, and affords for the user the faculty to change the stand configuration after buying it.

In addition, the different colors of the portions which stand proud through the strip 13 of each element 2 enables color coding of each knife to simplify its selection.

Picking up a knife is also simplified by the fan-like arrangement of the blade-receiving sockets.

Another major advantage of the stand according to the invention is that it may be laid down in any of the three positions shown in FIGS. 5–7, thereby the stand can be more flexible and versatile interior design-wise.

I claim:

1. A knife stand having a plurality of sockets for the blades of respective knives, the knife stand comprising a plurality of elements structurally independent of one another and being each formed with at least one of said sockets, said elements being laid side-by-side and held together into a tight pack, each of said elements comprising two parts in mutually releasable coupling relationship, said parts being separable across a plane extending longitudinally through said at lease one socket, a first one of said parts having a wall formed with a raised bead therefrom adapted to define the contour of said at least one socket, the second of said parts having a substantially flat surface adapted to rest on said bead to removably close off said socket.

2. A knife stand according to claim 1, characterized in that it comprises at least one tie rod for clamping said elements releasably together.

3. A knife stand according to claim 1, characterized in that each of said elements has at least one portion colored to provide for color coding of each socket.

4. A knife stand according to claim 2, characterized in that said elements defined two rest surfaces for said stand lying substantially at right angles to each other.

5. A knife stand according to claim 1, characterized in that said elements defined two rest surfaces for said stand lying substantially at right angles to each other.

6. A knife stand according to claim 5, characterized in that said elements are clamped between two opposing, substantially flat cheek pieces each defining a third rest surface for the stand.

7. A knife stand having a plurality of sockets for the blades of respective knives, the knife stand comprising a plurality of elements structurally independent of one another and being each formed with at least one of said sockets, said elements being laid side-by-side and held together into a tight pack, each of said elements comprising two parts in mutually releasable coupling relationship, said parts being separable across a plane extending longitudinally through said at lease one socket, each of said elements having at least one portion colored to provide for color coding of each socket, each of said parts having a peripheral strip formed with at least one cutout in a first one of said parts and with a corresponding enlarged portion on a second of said parts, said enlarged portion standing proud through the corresponding one of the cutouts to mark said color coding with said parts coupled together.

8. A knife stand according to claim 7, characterized in that said elements define two rest surfaces for said stand lying substantially at right angles to each other.

9. A knife stand according to claim 8, characterized in that said elements are clamped between two opposing, substantially flat cheek pieces each defining a third rest surface for the stand.

10. A knife stand according to claim 7, characterized in that said elements defined two rest surfaces for said stand lying substantially at right angles to each other.

11. A knife stand according to claim 10, characterized in that said elements are clamped between two opposing, substantially flat cheek pieces each defining a third rest surface for the stand.

* * * * *